US009153874B2

(12) United States Patent
Ouyang et al.

(10) Patent No.: US 9,153,874 B2
(45) Date of Patent: Oct. 6, 2015

(54) ELECTRONIC DEVICE HAVING MULTIPORT ANTENNA STRUCTURES WITH RESONATING SLOT

(71) Applicant: Apple Inc., Cupertino, CA (US)

(72) Inventors: Yuehui Ouyang, Sunnyvale, CA (US); Nanbo Jin, Sunnyvale, CA (US); Yijun Zhou, Sunnyvale, CA (US); Enrique Ayala Vazquez, Watsonville, CA (US); Anand Lakshmanan, San Jose, CA (US); Robert W. Schlub, Cupertino, CA (US); Mattia Pascolini, Campbell, CA (US); Matthew A. Mow, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 388 days.

(21) Appl. No.: 13/846,459

(22) Filed: Mar. 18, 2013

(65) Prior Publication Data

US 2014/0266938 A1 Sep. 18, 2014

(51) Int. Cl.

| | |
|---|---|
| ***H01Q 1/24*** | (2006.01) |
| ***H01Q 1/38*** | (2006.01) |
| ***H01Q 21/28*** | (2006.01) |
| ***H01Q 1/48*** | (2006.01) |
| ***H01Q 9/04*** | (2006.01) |

(Continued)

(52) U.S. Cl.

CPC ..... *H01Q 21/28* (2013.01); *H01Q 1/243* (2013.01); *H01Q 1/48* (2013.01); *H01Q 5/321* (2015.01); *H01Q 5/328* (2015.01); *H01Q 5/335* (2015.01); *H01Q 5/378* (2015.01); *H01Q 9/0421* (2013.01); *H01Q 13/106* (2013.01)

(58) Field of Classification Search

USPC ..... 343/702, 729, 745, 700 MS, 766

See application file for complete search history.

(56) References Cited

U.S. PATENT DOCUMENTS

| | | | |
|---|---|---|---|
| 6,317,094 | B1 | 11/2001 | Wu et al. |
| 6,762,729 | B2 | 7/2004 | Egashira |

(Continued)

FOREIGN PATENT DOCUMENTS

| | | |
|---|---|---|
| EP | 1501154 | 4/2007 |
| EP | 2528165 | 11/2012 |
| WO | 2011158057 | 12/2011 |

OTHER PUBLICATIONS

Darnell et al., U.S. Appl. No. 13/368,855, filed Feb. 8, 2012.

(Continued)

*Primary Examiner* — Tan Ho

(74) *Attorney, Agent, or Firm* — Treyz Law Group; G. Victor Treyz; Michael H. Lyons

(57) ABSTRACT

Electronic devices may include radio-frequency transceiver circuitry and antenna structures. The antenna structures may include an inverted-F antenna resonating element and an antenna ground that form an inverted-F antenna having first and second antenna ports. The antenna structures may include a slot antenna resonating element. The slot antenna resonating element may serve as a parasitic antenna resonating element for the inverted-F antenna at frequencies in a first communications band and may serve as a slot antenna at frequencies in a second communications band. The slot antenna may be directly fed using a third antenna port. An adjustable capacitor may be coupled to the first port to tune the inverted-F antenna. The inverted-F antenna may also be tuned using an adjustable capacitor bridging the slot antenna resonating element.

30 Claims, 6 Drawing Sheets

(51) Int. Cl.

| | |
|---|---|
| ***H01Q 13/10*** | (2006.01) |
| ***H01Q 5/321*** | (2015.01) |
| ***H01Q 5/328*** | (2015.01) |
| ***H01Q 5/335*** | (2015.01) |
| ***H01Q 5/378*** | (2015.01) |

(56) References Cited

U.S. PATENT DOCUMENTS

| | | | | |
|---|---|---|---|---|
| 7,075,493 | B2 | 7/2006 | Azadegan et al. | |
| 7,145,513 | B1 | 12/2006 | Cohen | |
| 7,183,982 | B2 | 2/2007 | Kadambi et al. | |
| 7,408,515 | B2 | 8/2008 | Leisten | |
| 7,889,143 | B2 | 2/2011 | Milosavljevic et al. | |
| 7,924,226 | B2 | 4/2011 | Soler Castany et al. | |
| 8,111,640 | B2 | 2/2012 | Knox | |
| 8,270,914 | B2 | 9/2012 | Pascolini et al. | |
| 2008/0316115 | A1* | 12/2008 | Hill et al. | 343/702 |
| 2009/0322639 | A1* | 12/2009 | Lai | 343/770 |
| 2010/0231470 | A1 | 9/2010 | Lee et al. | |
| 2010/0279734 | A1 | 11/2010 | Karkinen et al. | |
| 2011/0188552 | A1 | 8/2011 | Yoon et al. | |
| 2011/0241949 | A1 | 10/2011 | Nickel et al. | |
| 2011/0250928 | A1 | 10/2011 | Schlub et al. | |
| 2012/0169552 | A1 | 7/2012 | Lee et al. | |
| 2012/0176292 | A1 | 7/2012 | Hung et al. | |
| 2012/0229347 | A1* | 9/2012 | Jin et al. | 343/702 |
| 2013/0050046 | A1 | 2/2013 | Jarvis et al. | |
| 2014/0062815 | A1* | 3/2014 | Tsai et al. | 343/745 |
| 2014/0266922 | A1* | 9/2014 | Jin et al. | 343/702 |
| 2015/0061952 | A1* | 3/2015 | Chiang et al. | 343/749 |

OTHER PUBLICATIONS

Jin et al., U.S. Appl. No. 13/846,471, filed Mar. 18, 2013.
Zhou et al., U.S. Appl. No. 13/846,481, filed Mar. 18, 2013.

* cited by examiner

ELECTRONIC DEVICE HAVING MULTIPORT ANTENNA STRUCTURES WITH RESONATING SLOT

BACKGROUND

This relates generally to electronic devices, and more particularly, to antennas for electronic devices with wireless communications circuitry.

Electronic devices such as portable computers and cellular telephones are often provided with wireless communications capabilities. For example, electronic devices may use long-range wireless communications circuitry such as cellular telephone circuitry to communicate using cellular telephone bands. Electronic devices may use short-range wireless communications circuitry such as wireless local area network communications circuitry to handle communications with nearby equipment. Electronic devices may also be provided with satellite navigation system receivers and other wireless circuitry.

To satisfy consumer demand for small form factor wireless devices, manufacturers are continually striving to implement wireless communications circuitry such as antenna components using compact structures. At the same time, it may be desirable to include conductive structures in an electronic device such as metal device housing components. Because conductive components can affect radio-frequency performance, care must be taken when incorporating antennas into an electronic device that includes conductive structures. Moreover, care must be taken to ensure that the antennas and wireless circuitry in a device are able to exhibit satisfactory performance over a range of operating frequencies.

It would therefore be desirable to be able to provide improved wireless communications circuitry for wireless electronic devices.

SUMMARY

Electronic devices may include radio-frequency transceiver circuitry and antenna structures. The antenna structures may include an inverted-F antenna resonating element and an antenna ground that form an inverted-F antenna having first and second antenna ports. The antenna structures may include a slot antenna resonating element. The slot antenna resonating element may serve as a parasitic antenna resonating element for the inverted-F antenna and may serve as a slot antenna. The slot antenna may be fed using a third antenna port.

The inverted-F antenna may be configured to cover cellular telephone signals in a low band and a high band using the first antenna port. The inverted-F antenna may also handle wireless local area network signals using the inverted-F antenna. Wireless local area network signals in a communications band that is at higher frequencies than the high band cellular telephone communications band may be handled by the slot antenna using the third antenna port. Using the second antenna port, the inverted-F antenna may receive satellite navigation system signals.

Wireless circuitry may be coupled to the antenna structures. The wireless circuitry may include a satellite navigation system receiver coupled to the second port. The wireless circuitry may also include a wireless local area network transceiver and a cellular telephone transceiver. Duplexer circuitry may have a port that is coupled to the cellular telephone transceiver, a port that is coupled to the wireless local area network transceiver and a shared port coupled to the first antenna port of the inverted-F antenna.

The wireless local area network transceiver may have a port that is coupled to the slot antenna at the third antenna port. The slot antenna may be used in handling wireless local area network signals in a band such as a 5 GHz wireless local area network band. Signals associated with a wireless local area network band at 2.4 GHz may be routed to and from the first port of the inverted-F antenna using the duplexer circuitry.

An adjustable capacitor may be coupled to the first antenna port to tune the inverted-F antenna in the cellular telephone low band. The inverted-F antenna may also be tuned using an adjustable capacitor that bridges the slot antenna resonating element. Adjustments to the adjustable capacitor that bridges the slot antenna resonating element may be used, for example, to tune antenna performance in a communications band that includes the wireless local area network band at 2.4 GHz and nearby cellular telephone frequencies.

Further features of the invention, its nature and various advantages will be more apparent from the accompanying drawings and the following detailed description of the preferred embodiments.

DETAILED DESCRIPTION

Figure 1:
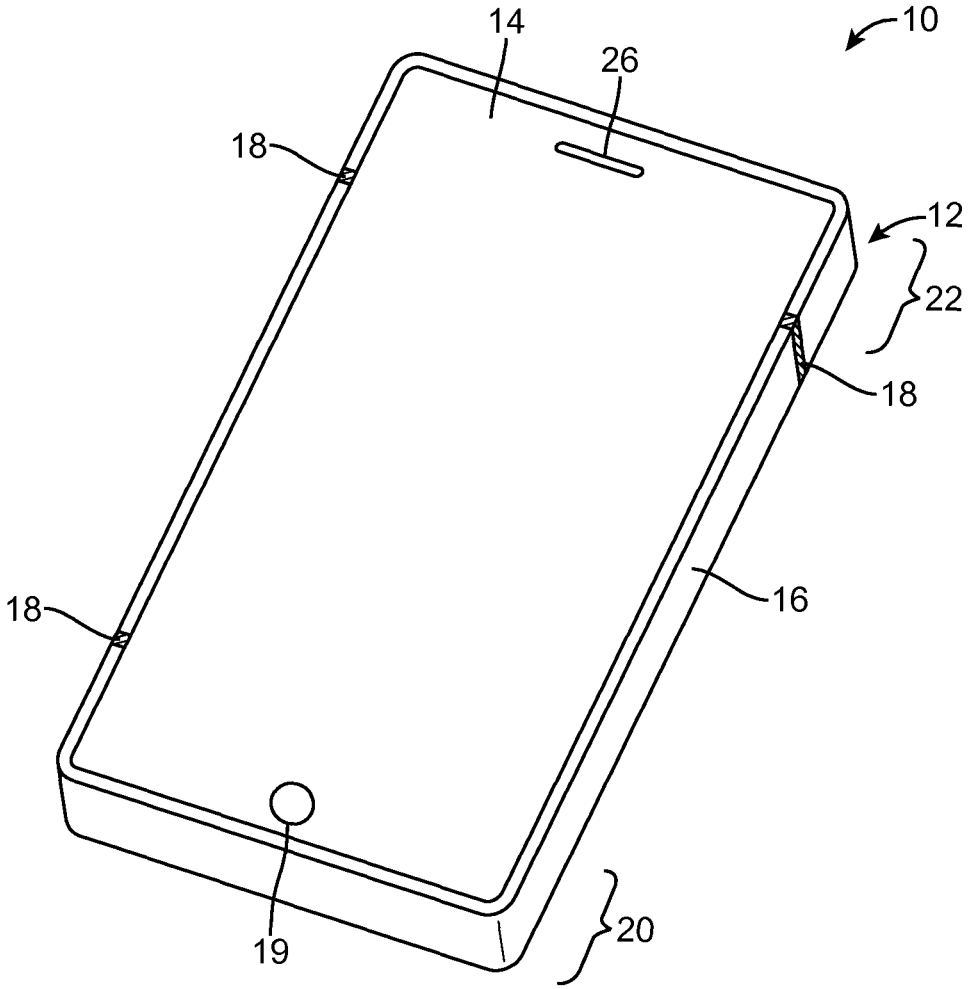
FIG. 1 is a perspective view of an illustrative electronic device with wireless communications circuitry in accordance with an embodiment of the present invention.

Electronic devices such as electronic device 10 of FIG. 1 may be provided with wireless communications circuitry. The wireless communications circuitry may be used to support wireless communications in multiple wireless communications bands. The wireless communications circuitry may include one or more antennas.

The antennas can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures. The conductive electronic device structures may include conductive housing structures. The housing structures may include peripheral structures such as a peripheral conductive member that runs around the periphery of an electronic device. The peripheral conductive member may serve as a bezel for a planar structure such as a display, may serve as sidewall structures for a device housing, and/or may form other housing structures. Gaps in the peripheral conductive member may be associated with the antennas.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a cellular telephone, or a media player. Device 10 may also be a television, a set-top box, a desktop computer, a computer monitor into which a computer has been integrated, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Device 10 may, if desired, have a display such as display 14. Display 14 may, for example, be a touch screen that incorporates capacitive touch electrodes. Display 14 may include image pixels formed from light-emitting diodes (LEDs), organic LEDs (OLEDs), plasma cells, electrowetting pixels, electrophoretic pixels, liquid crystal display (LCD) components, or other suitable image pixel structures. A display cover layer such as a layer of clear glass or plastic may cover the surface of display 14. Buttons such as button 19 may pass through openings in the cover layer. The cover layer may also have other openings such as an opening for speaker port 26.

Housing 12 may include peripheral housing structures such as structures 16. Structures 16 may run around the periphery of device 10 and display 14. In configurations in which device 10 and display 14 have a rectangular shape, structures 16 may be implemented using a peripheral housing member have a rectangular ring shape (as an example). Peripheral structures 16 or part of peripheral structures 16 may serve as a bezel for display 14 (e.g., a cosmetic trim that surrounds all four sides of display 14 and/or helps hold display 14 to device 10). Peripheral structures 16 may also, if desired, form sidewall structures for device 10 (e.g., by forming a metal band with vertical sidewalls, etc.).

Peripheral housing structures 16 may be formed of a conductive material such as metal and may therefore sometimes be referred to as peripheral conductive housing structures, conductive housing structures, peripheral metal structures, or a peripheral conductive housing member (as examples). Peripheral housing structures 16 may be formed from a metal such as stainless steel, aluminum, or other suitable materials. One, two, or more than two separate structures may be used in forming peripheral housing structures 16.

It is not necessary for peripheral housing structures 16 to have a uniform cross-section. For example, the top portion of peripheral housing structures 16 may, if desired, have an inwardly protruding lip that helps hold display 14 in place. If desired, the bottom portion of peripheral housing structures 16 may also have an enlarged lip (e.g., in the plane of the rear surface of device 10). In the example of FIG. 1, peripheral housing structures 16 have substantially straight vertical sidewalls. This is merely illustrative. The sidewalls formed by peripheral housing structures 16 may be curved or may have other suitable shapes. In some configurations (e.g., when peripheral housing structures 16 serve as a bezel for display 14), peripheral housing structures 16 may run around the lip of housing 12 (i.e., peripheral housing structures 16 may cover only the edge of housing 12 that surrounds display 14 and not the rest of the sidewalls of housing 12).

If desired, housing 12 may have a conductive rear surface. For example, housing 12 may be formed from a metal such as stainless steel or aluminum. The rear surface of housing 12 may lie in a plane that is parallel to display 14. In configurations for device 10 in which the rear surface of housing 12 is formed from metal, it may be desirable to form parts of peripheral conductive housing structures 16 as integral portions of the housing structures forming the rear surface of housing 12. For example, a rear housing wall of device 10 may be formed from a planar metal structure and portions of peripheral housing structures 16 on the left and right sides of housing 12 may be formed as vertically extending integral metal portions of the planar metal structure. Housing structures such as these may, if desired, be machined from a block of metal.

Display 14 may include conductive structures such as an array of capacitive electrodes, conductive lines for addressing pixel elements, driver circuits, etc. Housing 12 may include internal structures such as metal frame members, a planar housing member (sometimes referred to as a midplate) that spans the walls of housing 12 (i.e., a substantially rectangular sheet formed from one or more parts that is welded or otherwise connected between opposing sides of member 16), printed circuit boards, and other internal conductive structures. These conductive structures may be located in the center of housing 12 under display 14 (as an example).

In regions 22 and 20, openings may be formed within the conductive structures of device 10 (e.g., between peripheral conductive housing structures 16 and opposing conductive structures such as conductive housing midplate or rear housing wall structures, a conductive ground plane associated with a printed circuit board, and conductive electrical components in device 10). These openings, which may sometimes be referred to as gaps, may be filled with air, plastic, and other dielectrics. Conductive housing structures and other conductive structures in device 10 may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 22.

In general, device 10 may include any suitable number of antennas (e.g., one or more, two or more, three or more, four or more, etc.). The antennas in device 10 may be located at opposing first and second ends of an elongated device housing, along one or more edges of a device housing, in the center of a device housing, in other suitable locations, or in one or more of such locations. The arrangement of FIG. 1 is merely illustrative.

Portions of peripheral housing structures 16 may be provided with gap structures. For example, peripheral housing structures 16 may be provided with one or more gaps such as gaps 18, as shown in FIG. 1. The gaps in peripheral housing structures 16 may be filled with dielectric such as polymer, ceramic, glass, air, other dielectric materials, or combinations of these materials. Gaps 18 may divide peripheral housing structures 16 into one or more peripheral conductive segments. There may be, for example, two peripheral conductive segments in peripheral housing structures 16 (e.g., in an arrangement with two gaps), three peripheral conductive segments (e.g., in an arrangement with three gaps), four peripheral conductive segments (e.g., in an arrangement with four gaps, etc.). The segments of peripheral conductive housing structures 16 that are formed in this way may form parts of antennas in device 10.

In a typical scenario, device 10 may have upper and lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, etc.

Figure 2:
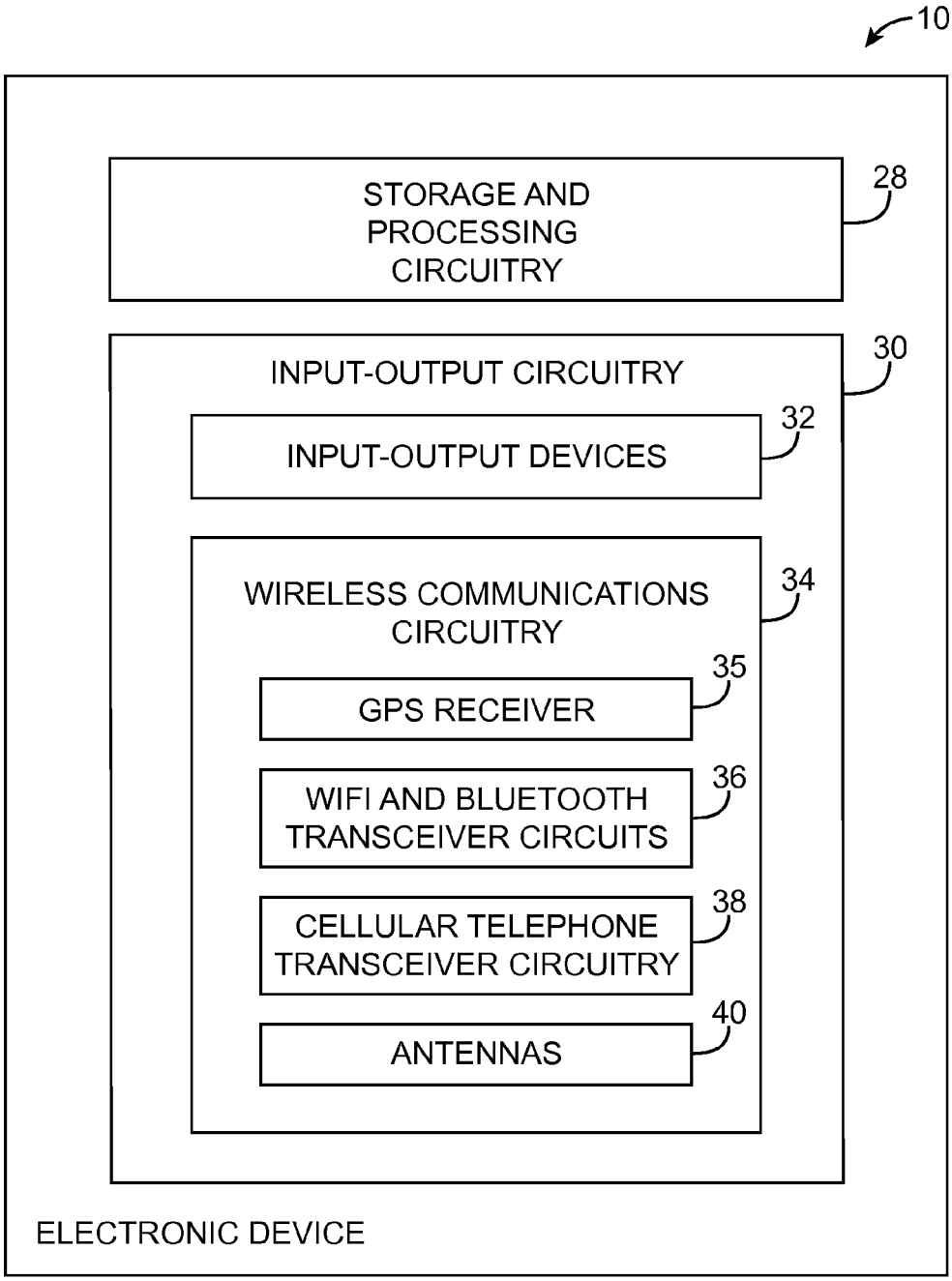
FIG. 2 is a schematic diagram of an illustrative electronic device with wireless communications circuitry in accordance with an embodiment of the present invention.

A schematic diagram of an illustrative configuration that may be used for electronic device 10 is shown in FIG. 2. As shown in FIG. 2, electronic device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. The processing circuitry may be based on one or more microprocessors, microcontrollers, digital signal processors, baseband processors, power management units, audio codec chips, application specific integrated circuits, etc.

Storage and processing circuitry 28 may be used to run software on device 10, such as internet browsing applications, voice-over-internet-protocol (VoIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, etc.

Circuitry 28 may be configured to implement control algorithms that control the use of antennas in device 10. For example, circuitry 28 may perform signal quality monitoring operations, sensor monitoring operations, and other data gathering operations and may, in response to the gathered data and information on which communications bands are to be used in device 10, control which antenna structures within device 10 are being used to receive and process data and/or may adjust one or more switches, tunable elements, or other adjustable circuits in device 10 to adjust antenna performance. As an example, circuitry 28 may control which of two or more antennas is being used to receive incoming radio-frequency signals, may control which of two or more antennas is being used to transmit radio-frequency signals, may control the process of routing incoming data streams over two or more antennas in device 10 in parallel, may tune an antenna to cover a desired communications band, etc.

In performing these control operations, circuitry 28 may open and close switches, may turn on and off receivers and transmitters, may adjust impedance matching circuits, may configure switches in front-end-module (FEM) radio-frequency circuits that are interposed between radio-frequency transceiver circuitry and antenna structures (e.g., filtering and switching circuits used for impedance matching and signal routing), may adjust switches, tunable circuits, and other adjustable circuit elements that are formed as part of an antenna or that are coupled to an antenna or a signal path associated with an antenna, and may otherwise control and adjust the components of device 10.

Input-output circuitry 30 may be used to allow data to be supplied to device 10 and to allow data to be provided from device 10 to external devices. Input-output circuitry 30 may include input-output devices 32. Input-output devices 32 may include touch screens, buttons, joysticks, click wheels, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 32 and may receive status information and other output from device 10 using the output resources of input-output devices 32.

Wireless communications circuitry 34 may include radio-frequency (RF) transceiver circuitry formed from one or more integrated circuits, power amplifier circuitry, low-noise input amplifiers, passive RF components, one or more antennas, filters, duplexers, and other circuitry for handling RF wireless signals. Wireless signals can also be sent using light (e.g., using infrared communications).

Wireless communications circuitry 34 may include satellite navigation system receiver circuitry such as Global Positioning System (GPS) receiver circuitry 35 (e.g., for receiving satellite positioning signals at 1575 MHz) or satellite navigation system receiver circuitry associated with other satellite navigation systems. Wireless local area network transceiver circuitry such as transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in cellular telephone bands such as bands in frequency ranges of about 700 MHz to about 2700 MHz or bands at higher or lower frequencies. Wireless communications circuitry 34 can include circuitry for other short-range and long-range wireless links if desired. For example, wireless communications circuitry 34 may include wireless circuitry for receiving radio and television signals, paging circuits, etc. Near field communications may also be supported (e.g., at 13.56 MHz). In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may have antenna structures such as one or more antennas 40. Antennas structures 40 may be formed using any suitable antenna types. For example, antennas structures 40 may include antennas with resonating elements that are formed from loop antenna structures, patch antenna structures, inverted-F antenna structures, dual arm inverted-F antenna structures, closed and open slot antenna structures, planar inverted-F antenna structures, helical antenna structures, strip antennas, monopoles, dipoles, hybrids of these designs, etc. Different types of antennas may be used for different bands and combinations of bands. For example, one type of antenna may be used in forming a local wireless link antenna and another type of antenna may be used in forming a remote wireless link. Antenna structures in device 10 such as one or more of antennas 40 may be provided with one or more antenna feeds, fixed and/or adjustable components, and optional parasitic antenna resonating elements so that the antenna structures cover desired communications bands.

Figure 3:
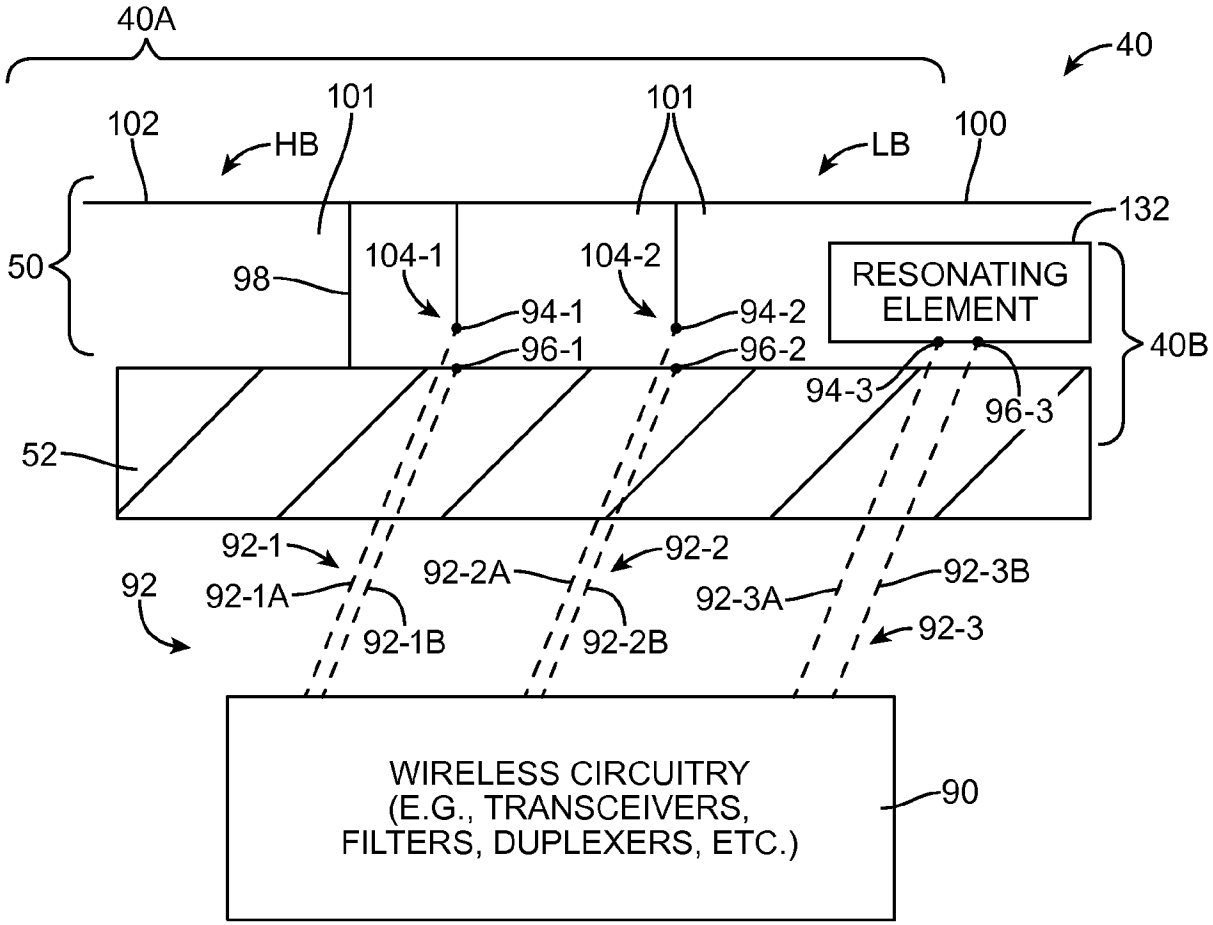
FIG. 3 is a diagram of an illustrative tunable antenna in accordance with an embodiment of the present invention.

Illustrative antenna structures of the type that may be used in device 10 (e.g., in region 20 and/or region 22) are shown in FIG. 3. Antenna structures 40 of FIG. 3 include an antenna resonating element of the type that is sometimes referred to as a dual arm inverted-F antenna resonating element or T antenna resonating element. As shown in FIG. 3, antenna structures 40 may have conductive antenna structures such as dual arm inverted-F antenna resonating element 50 and additional antenna resonating element 132. Antenna resonating element 132 may operate as a near-field coupled parasitic antenna resonating element and as a directly fed antenna resonating element. Antenna structures 40 of FIG. 3 also include antenna ground 52.

The conductive structures that form antenna resonating element 50, antenna resonating element 132, and antenna ground 52 may be formed from parts of conductive housing structures, from parts of electrical device components in device 10, from printed circuit board traces, from strips of conductor such as strips of wire and metal foil, or may be formed using other conductive structures.

Antenna resonating element 50 and antenna ground 52 may form first antenna structures 40A (e.g., a first antenna such as a dual arm inverted-F antenna). Resonating element 132 and antenna ground 52 may form second antenna structures 40B (e.g., a second antenna). If desired, resonating element 132 may also form a parasitic antenna resonating element (e.g., an element that is not directly fed). Resonating element 132 may, for example, form a parasitic antenna element that contributes to the response of antenna 40A during operation of antenna structures 40 at certain frequencies.

As shown in FIG. 3, antenna structures 40 may be coupled to wireless circuitry 90 such as transceiver circuitry, filters, switches, duplexers, impedance matching circuitry, and other circuitry using transmission line structures such as transmission line structures 92. Transmission line structures 92 may include transmission lines such as transmission line 92-1, transmission line 92-2, and transmission line 92-3. Transmission line 92-1 may have positive signal path 92-1A and ground signal path 92-1B. Transmission line 92-2 may have positive signal path 92-2A and ground signal path 92-2B. Transmission line 92-3 may have positive signal path 92-3A and ground signal path 92-3B. Paths 92-1A, 92-1B, 92-2A, 92-2B, 92-3A, and 92-3B may be formed from metal traces on rigid printed circuit boards, may be formed from metal traces on flexible printed circuits, may be formed on dielectric support structures such as plastic, glass, and ceramic members, may be formed as part of a cable, or may be formed from other conductive signal lines. Transmission line structures 92 may be formed using one or more microstrip transmission lines, stripline transmission lines, edge coupled microstrip transmission lines, edge coupled stripline transmission lines, coaxial cables, or other suitable transmission line structures. Circuits such as impedance mating circuits, filters, switches, duplexers, diplexers, and other circuitry may, if desired, be interposed in the transmission lines of structures 92.

Transmission line structures 92 may be coupled to antenna ports formed using antenna port terminals 94-1 and 96-1 (which form a first antenna port), antenna port terminals 94-2 and 96-2 (which form a second antenna port), and antenna port terminals 94-3 and 96-3 (which form a third antenna port). The antenna ports may sometimes be referred to as antenna feeds. For example, terminal 94-1 may be a positive antenna feed terminal and terminal 96-1 may be a ground antenna feed terminal for a first antenna feed, terminal 94-2 may be a positive antenna feed terminal and terminal 96-2 may be a ground antenna feed terminal for a second antenna feed, and terminal 94-3 may be a positive antenna feed terminal and terminal 96-3 may be a ground antenna feed terminal for a third antenna feed.

Each antenna port in antenna structures 40 may be used in handling a different type of wireless signals. For example, the first port may be used for transmitting and/or receiving antenna signals in a first communications band or first set of communications bands, the second port may be used for transmitting and/or receiving antenna signals in a second communications band or second set of communications bands, and the third port may be used for transmitting and/or receiving antenna signals in a third communications band or third set of communications bands.

If desired, tunable components such as adjustable capacitors, adjustable inductors, filter circuitry, switches, impedance matching circuitry, duplexers, and other circuitry may be interposed within transmission line paths (i.e., between wireless circuitry 90 and the respective ports of antenna structures 40). The different ports in antenna structures 40 may each exhibit a different impedance and antenna resonance behavior as a function of operating frequency. Wireless circuitry 90 may therefore use different ports for different types of communications. As an example, signals associated with communicating in one or more cellular communications band may be transmitted and received using one of the ports, whereas reception of satellite navigation system signals may be handled using a different one of the ports.

Antenna resonating element 50 may include a short circuit branch such as branch 98 that couples resonating element arm structures such as arms 100 and 102 to antenna ground 52. Dielectric gap 101 separates arms 100 and 102 from antenna ground 52. Antenna ground 52 may be formed from housing structures such as a metal midplate member, printed circuit traces, metal portions of electronic components, or other conductive ground structures. Gap 101 may be formed by air, plastic, and other dielectric materials. Short circuit branch 98 may be implemented using a strip of metal, a metal trace on a dielectric support structure such as a printed circuit or plastic carrier, or other conductive path that bridges gap 101 between resonating element arm structures (e.g., arm 102 and/or arm 100) and antenna ground 52.

The antenna port formed from terminals 94-1 and 96-1 may be coupled in a path such as path 104-1 that bridges gap 101. The antenna port formed from terminals 94-2 and 96-2 may be coupled in a path such as path 104-2 that bridges gap 101 in parallel with path 104-1 and short circuit path 98.

Resonating element arms 100 and 102 may form respective arms in a dual arm inverted-F antenna resonating element. Arms 100 and 102 may have one or more bends. The illustrative arrangement of FIG. 3 in which arms 100 and 102 run parallel to ground 52 is merely illustrative.

Arm 100 may be a (longer) low-band arm that handles lower frequencies, whereas arm 102 may be a (shorter) high-band arm that handles higher frequencies. Low-band arm 100 may allow antenna 40 to exhibit an antenna resonance at low band (LB) frequencies such as frequencies from 700 MHz to 960 MHz or other suitable frequencies. High-band arm 102 may allow antenna 40 to exhibit one or more antenna resonances at high band (HB) frequencies such as resonances at one or more ranges of frequencies between 960 MHz to 2700 MHz or other suitable frequencies. Antenna resonating element 50 may also exhibit an antenna resonance at 1575 MHz or other suitable frequency for supporting satellite navigation system communications such as Global Positioning System communications.

Antenna resonating element 132 may be used in supporting communications at additional frequencies (e.g., frequencies associated with a 2.4 GHz communications band such as an IEEE 802.11 wireless local area network band, a 5 GHz communications band such as an IEEE 802.11 wireless local area network band, and/or cellular frequencies such as frequencies in cellular bands near 2.4 GHz such as frequencies from 2.3 to 2.7 GHz).

Antenna resonating element 132 may, for example, be formed from a slot antenna resonating element that allows antenna resonating element 132 to serve as both a slot-based parasitic antenna resonating element and as a slot antenna. Antenna resonating element 132 may, for example, operate as a slot-based parasitic antenna resonating element at frequencies near 2.4 GHz to help ensure that antenna structures 40 will be able to handle signals associated with a 2.4 GHz IEEE 802.11 wireless local area network band and nearby cellular bands such as Long Term Evolution Bands 38 and 40 and may operate independently from antenna resonating element 50 as a directly fed slot antenna at frequencies of 5 GHz (e.g. to handle traffic in the 5 GHz IEEE 802.11 wireless local area network band).

During parasitic resonating element operations, the structures of antenna resonating element 132 are coupled to antenna resonating element 50 by near-field electromagnetic coupling and are used to modify the frequency response of antenna 40 so that antenna structures 40 operate with a desired frequency response (e.g., to support signals in a range of about 2.3 to 2.7 GHz as an example). At frequencies (e.g., 2.3 to 2.7 GHz) in which antenna resonating element 132 operates as a parasitic antenna resonating element, antenna resonating element 132 is not directly fed by the antenna feed formed from feed terminals 94-3 and 96-3, but rather is near field coupled to antenna resonating element 50 while the first or second antenna port is being used by wireless circuitry 90 to transmit and/or receive wireless signals.

To handle signals in other bands such as the 5 GHz IEEE 802.11 local wireless area network band, antenna resonating element 134 may be directly fed using an antenna feed formed from antenna feed terminals 94-3 and 96-3. Antenna resonating element 134 may contain a slot having a shape that is defined by the placement of surrounding conductive structures such as stamped metal structures, metal foil structures, metal traces on a flexible printed circuit (e.g., a printed circuit formed from a flexible substrate such as a layer of polyimide or a sheet of other polymer material), metal traces on a rigid printed circuit board substrate (e.g., a substrate formed from a layer of fiberglass-filled epoxy), metal traces on a plastic carrier, patterned metal on glass or ceramic support structures, wires, electronic device housing structures, metal parts of electrical components in device 10, or other conductive structures. The slot in antenna resonating element 134 may be an open slot structure that has one open end and one closed end (as an example). Slot structures with two closed ends may be used if desired.

A slot for antenna resonating element 134 may be formed between opposing metal structures in antenna resonating element 50 and/or antenna ground 52. Plastic, air, or other dielectric may fill the interior of a slot. Slots are typically elongated (i.e., their lengths are substantially longer than their widths). Metal surrounds the periphery of the slot. In an open slot, one of the ends of the slot is open to surrounding dielectric.

To provide antenna 40 with tuning capabilities, antenna 40 may include adjustable circuitry. The adjustable circuitry may be coupled between different locations on antenna resonating element 50, may be coupled between different locations on resonating element 132, may form part of paths such as paths 104-1 and 104-2 that bridge gap 101, may form part of transmission line structures 92 (e.g., circuitry interposed within one or more of the conductive lines in path 92-1, path 92-2, and/or path 92-3), or may be incorporated elsewhere in antenna structures 40, transmission line paths 92, and wireless circuitry 90.

The adjustable circuitry may be tuned using control signals from control circuitry 28 (FIG. 2). Control signals from control circuitry 28 may, for example, be provided to an adjustable capacitor, adjustable inductor, or other adjustable circuit using a control signal path that is coupled between control circuitry 28 and the adjustable circuit. Control circuitry 28 may provide control signals to adjust a capacitance exhibited by an adjustable capacitor, may provide control signals to adjust the inductance exhibited by an adjustable inductor, may provide control signals that adjust the impedance of a circuit that includes one or more components such fixed and variable capacitors, fixed and variable inductors, switching circuitry for switching electrical components such as capacitors and inductors into and out of use, resistors, and other adjustable circuitry, or may provide control signals to other adjustable circuitry for tuning the frequency response of antenna structures 40. As an example, antenna structures 40 may be provided with first and second adjustable capacitors. By selecting a desired capacitance value for each adjustable capacitor using control signals from control circuitry 28, antenna structures 40 can be tuned to cover operating frequencies of interest.

If desired, the adjustable circuitry of antenna structures 40 may include one or more adjustable circuits that are coupled to antenna resonating element structures 50 such as arms 102 and 100 in antenna resonating element 50, one or more adjustable circuits that are coupled across a slot in a slot-based resonating element (e.g., resonating element 132), and/or one or more adjustable circuits that are interposed within the signal lines associated with one or more of the ports for antenna structures 40 (e.g., paths 104-1, 104-2, paths 92, etc.).

Figure 4:
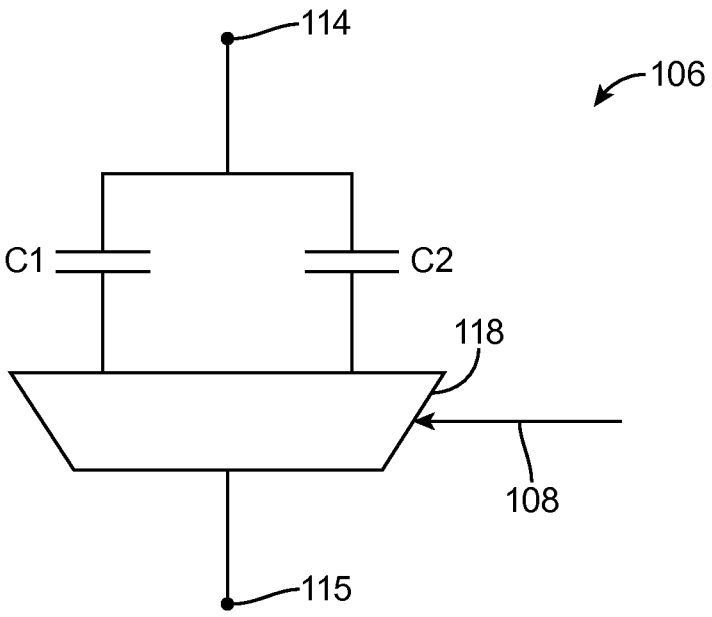
FIG. 4 is a diagram of an illustrative adjustable capacitor of the type that may be used in tuning antenna structures in an electronic device in accordance with an embodiment of the present invention.

FIG. 4 is a schematic diagram of an illustrative adjustable capacitor circuit of the type that may be used in tuning antenna structures 40. Adjustable capacitor 106 of FIG. 4 produces an adjustable amount of capacitance between terminals 114 and 115 in response to control signals provided to input path 108. Switching circuitry 118 has two terminals coupled respectively to capacitors C1 and C2 and has another terminal coupled to terminal 115 of adjustable capacitor 106. Capacitor C1 is coupled between terminal 114 and one of the terminals of switching circuitry 118. Capacitor C2 is coupled between terminal 114 and the other terminal of switching circuitry 118 in parallel with capacitor C1. By controlling the value of the control signals supplied to control input 108, switching circuitry 118 may be configured to produce a desired capacitance value between terminals 114 and 115. For example, switching circuitry 118 may be configured to switch capacitor C1 into use or may be configured to switch capacitor C2 into use.

If desired, switching circuitry 118 may include one or more switches or other switching resources that selectively decouple capacitors C1 and C2 (e.g., by forming an open circuit so that the path between terminals 114 and 115 is an open circuit and both capacitors are switched out of use). Switching circuitry 118 may also be configured (if desired) so that both capacitors C1 and C2 can be simultaneously switched into use. Other types of switching circuitry 118 such as switching circuitry that exhibits fewer switching states or more switching states may be used if desired. Capacitors C1 and C2 may be fixed capacitors. Adjustable capacitors such as adjustable capacitor 106 may also be implemented using variable capacitor devices for capacitors C1 and/or C2 (sometimes referred to as varactors). Adjustable capacitors such as capacitor 106 may include two capacitors, three capacitors, four capacitors, or other suitable numbers of capacitors. The configuration of FIG. 4 is merely illustrative.

During operation of device 10, control circuitry such as storage and processing circuitry 28 of FIG. 2 may make antenna adjustments by providing control signals to adjustable components such as one or more adjustable capacitors 106. If desired, control circuitry 28 may also make antenna tuning adjustments using adjustable inductors or other adjustable circuitry. Antenna frequency response adjustments may be made in real time in response to information identifying which communications bands are active, in response to feedback related to signal quality or other performance metrics, in response to sensor information, or based on other information.

Figure 5:
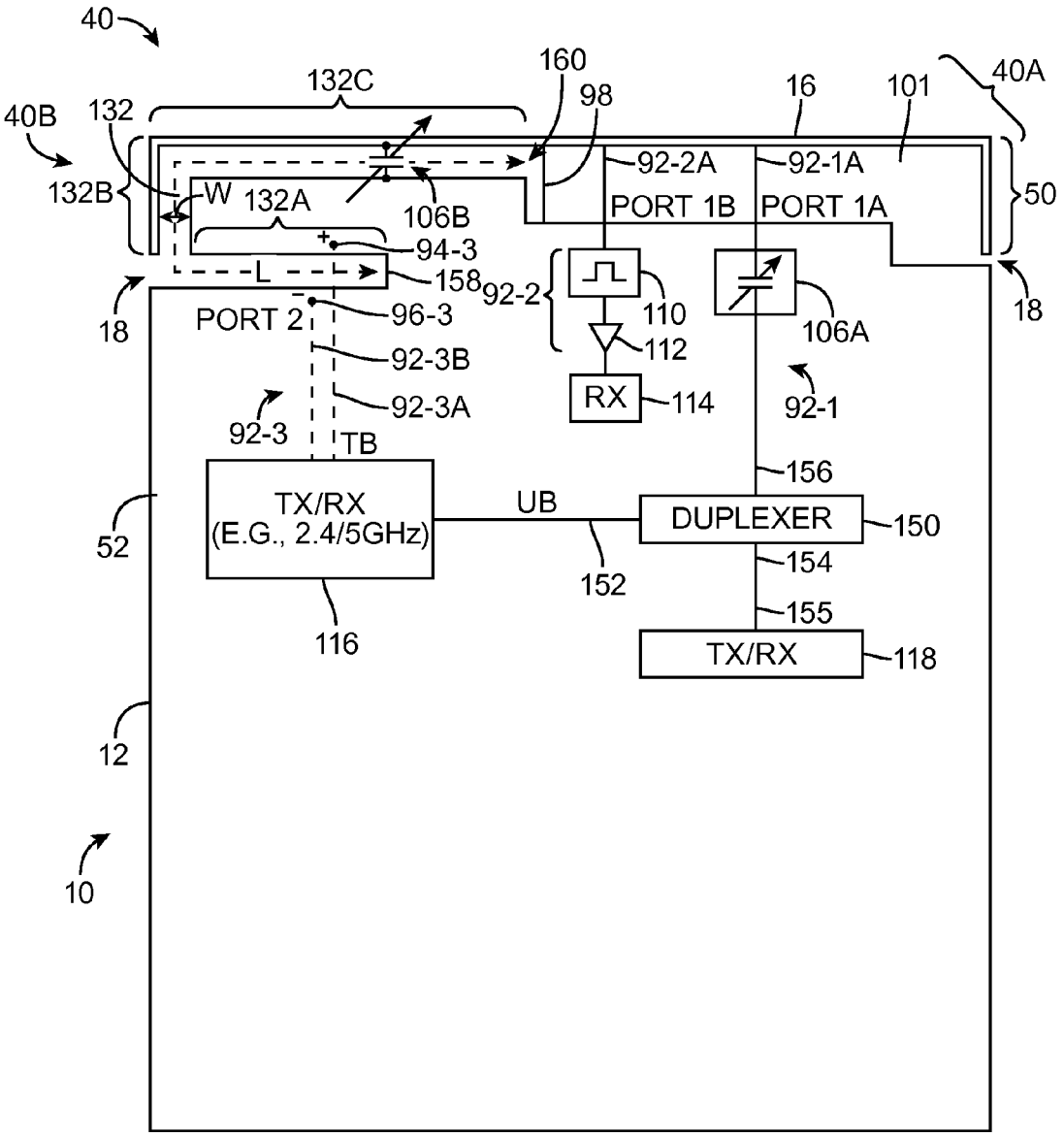
FIG. 5 is a diagram of illustrative tunable electronic device antenna structures having a dual arm inverted-F antenna resonating element with two antenna ports that is formed from a housing structure and having a slot-based antenna resonating element coupled to another antenna port in accordance with an embodiment of the present invention.

FIG. 5 is a diagram of an electronic device with illustrative adjustable antenna structures 40. In the illustrative configuration of FIG. 5, electronic device 10 has adjustable antenna structures 40 that are implemented using conductive structures in electronic device 10. As shown in FIG. 5, antenna structures 40 include peripheral conductive electronic device housing structures such as peripheral conductive housing member 16 and include antenna ground 52. Short circuit path 98 may bridge dielectric gap 101. Peripheral conductive housing member 16 may have arms (to the left and right of short circuit path 98) that form low band (LB) and high band (HB) resonating element arm portions of a dual arm inverted-F antenna resonating element. The inverted-F antenna resonating element formed by peripheral conductive member 16 and antenna ground 52 may form dual arm inverted-F antenna 40A. Antenna 40A may have multiple ports such as port 1A (having signal line 92-1A coupled to peripheral conductive housing member 16) and port 1B (having signal line 92-2A coupled to peripheral conductive housing member 16).

As shown in FIG. 5, antenna structures 40 also include a slot-based antenna resonating element 132 (i.e., a slot). Slot 132 is formed from an opening (e.g., a dielectric opening formed from air, plastic, and other dielectric materials) between opposing conductive structures in device 10. Slot 132 has an elongated shape with a length L that is longer than its width W. Slot 132 may be formed from a straight opening or an opening with one or more bends. In the example of FIG. 5, slot 132 has three segments—segment 132A, segment 132B, and segment 132C. Segment 132C has open end 160. Open end 160 is open to dielectric gap 101. The outer edge of slot portion 132C is defined by a portion of peripheral conductive housing member 16. The inner edge of slot portion 132C is defined by an opposing parallel portion of antenna ground 52. Segment 132A has closed end 158. Closed end 158 is formed by portions of antenna ground 52. The sides of segment 132A are formed from opposing portions of antenna ground 52. Intermediate segment 132B runs perpendicular to slot portions 132A and 132C and couples slot portions 132A and 132C to form slot 132. The outer edge of slot segment 132B is formed by a portion of peripheral conductive housing member 16. The opposing inner edge of slot segment 132B is formed by a portion of antenna ground 52.

Slot 132 may form two types of antenna elements: a slot antenna for handling communications in a 5 GHz band (as an example) and a slot-based parasitic antenna resonating element for helping ensure that antenna 40A can cover desired frequencies of interest from 2.3 to 2.7 GHz (as an example).

In particular, in a communications band such as a 5 GHz IEEE 802.11 wireless local area network communications band (sometimes referred to as band TB), slot 132 may form a directly fed slot antenna that is fed at antenna port 2. The antenna feed for slot 132 is formed by terminals that bridge slot 132. As shown in FIG. 5, transmission line 92-3 may have a positive signal line 92-3A that is coupled to positive antenna feed terminal 94-3 in port 2 and may have a ground signal line 92-3B that is coupled to antenna ground terminal 96-3. Transmission line 92-3 may couple port 2 of slot antenna 132 to transceiver port TB of transceiver 116. Transceiver port TB may be used to transmit and receive 5 GHz wireless local area network signals using the 5 GHz slot antenna formed from slot 132.

At frequencies of 2.3 to 2.7 GHz (sometimes referred to as band UB), slot-based parasitic antenna resonating element 132 may be near-field coupled to antenna 40A and may give rise to an antenna response that allows signals to be transmitted and received by antenna 40A using port 1A. Adjustable capacitor 106B may bridge slot 132 to ensure that the resonance associated with slot-based parasitic antenna resonating element 132 falls within the 2.3 to 2.7 GHz band. Capacitor 106B may, as an example, be provided with a fixed capacitor C1 of about 0.2 pF and a fixed capacitor C2 of about 0.4 pF, allowing the capacitance of adjustable capacitor 106B to be adjusted over a range of capacitances such as a capacitance of 0.6 pF (when C1 and C2 are both switched into use in parallel), 0.2 pF (when C1 is switched into use), 0.4 pF (when capacitor C2 is switched into use) and zero (when capacitors C1 and C2 are both switched out of use). In the presence of adjustable capacitor 106B, the resonant frequency of slot-based parasitic antenna resonating element 132 may be reduced to about 2.4 GHz. The capacitance adjustments produced using adjustable capacitor 106B help ensure that the resonance produced by slot-based parasitic antenna resonating element 132 covers the entire frequency band of interest (e.g., all frequencies from 2.3 GHz to 2.7 GHz in this example).

As described in connection with FIG. 3, antenna structures 40 may have three antenna ports. Port 1A may be coupled to the antenna resonating element arms of dual arm antenna resonating element 50 at a first location along member 16 (see, e.g., path 92-1A, which is coupled to member 16 at terminal 94-1). Port 1B may be coupled to the antenna resonating element arm structures of dual arm antenna resonating element 50 at a second location that is different than the first location (see, e.g., path 92-2A, which is coupled to member 16 at terminal 94-2).

Adjustable capacitor 106A (e.g., a capacitor of the type shown in FIG. 4) may be interposed in path 92-1A and coupled to port 1A for use in tuning antenna structures 40 (e.g., for tuning dual arm inverted-F antenna 40A). Global positioning system (GPS) signals may be received using port 1B of antenna 40A. Transmission line path 92-2 may be coupled between port 1B and satellite navigation system receiver 114 (e.g., a Global Positioning System receiver such as satellite navigation system receiver 35 of FIG. 2). Circuitry such as band pass filter 110 and amplifier 112 may, if desired, be interposed within transmission line path 92-2. During operation, satellite navigation system signals may pass from antenna 40A to receiver 114 via filter 110 and amplifier 112.

Antenna resonating element 50 may cover frequencies such as frequencies in a low band (LB) communications band extending from about 700 MHz to 960 MHz and, if desired, a high band (HB) communications band extending from about 1.7 to 2.2 GHz (as examples). Adjustable capacitor 106A may be used in tuning low band performance in band LB, so that all desired frequencies between 700 MHz and 960 MHz can be covered. Slot antenna resonating element 132 may serve as a parasitic antenna resonating element that gives rise to an antenna resonance for antenna 40A (port 1A) that can be tuned using adjustable capacitor 106B to cover all frequencies from 2.3 GHz to 2.7 GHz in a communications band UB.

Port 2 may use path 92-3 to feed slot antenna resonating element 132 (antenna 40B) so that element 132 operates as an antenna. In the illustrative arrangement of FIG. 5, antenna resonating element 132 is a slot antenna when fed at port 2 and is configured to handle a communications band at 5 GHz (sometimes referred to as band TB) such as an IEEE 802.11 wireless local area network band.

Wireless circuitry 90 may include satellite navigation system receiver 114 and radio-frequency transceiver circuitry such as radio-frequency transceiver circuitry 116 and 118. Receiver 114 may be a Global Positioning System receiver or other satellite navigation system receiver (e.g., receiver 35 of FIG. 2).

Transceiver 116 may be a wireless local area network transceiver such as radio-frequency transceiver 36 of FIG. 2 that operates in bands such as a 2.4 GHz band and a 5 GHz band. Transceiver 116 may be, for example, an IEEE 802.11 radio-frequency transceiver (sometimes referred to as a WiFi® transceiver). Transceiver 116 may have a port such as port TB that handles 5 GHz communications using slot 132 (i.e., using slot 132 in a mode in which slot 132 forms a slot antenna). Transceiver 116 may also have a port such as port UB that handles 2.4 GHz communications. Port UB may be coupled to port 152 of duplexer 150.

Duplexer 150 may have a port such as port 154 that is coupled to transceiver 118. Transceiver 118 may be a cellular transceiver such as cellular transceiver 38 of FIG. 2 that is configured to handle voice and data traffic in one or more cellular bands. Examples of cellular bands that may be covered include a band (e.g., low band LB) ranging from 700 MHz to 960 MHz, a band (e.g., a high band HB) ranging from about 1.7 to 2.2 GHz), and Long Term Evolution (LTE) bands 38 and 40.

Long Term Evolution band 38 is associated with frequencies of about 2.6 GHz. Long Term Evolution band 40 is associated with frequencies of about 2.3 to 2.4 GHz. Port 155 transceiver 118 may be used to handle cellular signals in band LB (700 MHz to 960 MHz) and, if desired, in band HB (1.7 to 2.2 GHz). Port 155 may also be used to handle communications in LTE band 38 and LTE band 40. As shown in FIG. 5, port 155 of transceiver 118 may be coupled to port 154 of duplexer circuitry 150. Duplexer circuitry 150 may contain one or more duplexers.

Duplexer circuitry 150 uses frequency multiplexing to route the signals between ports 152 and 154 and shared duplexer port 156. Shared port 156 is coupled to transmission line path 92-1. With this arrangement, 2.4 GHz WiFi® signals associated with transceiver port UB of transceiver 116 and port 152 of duplexer 150 may be routed to and from path 92-1 and LTE band 38/40 signals and cellular telephone signals in band LB and HB associated with port 154 and port 155 of transceiver 118 may be routed to and from path 92-1. During operation of device 10, adjustable capacitor 106A can be adjusted to tune the antenna formed from antenna resonating element 50 and antenna ground 52 as needed to handle the traffic associated with band UB (i.e., to handle the 2.4 GHz traffic from port UB of transceiver 116 and to handle the LTE band 38/40 traffic and other cellular traffic in the range of 2.3 GHz to 2.7 GHz from transceiver 118).

Figure 6:
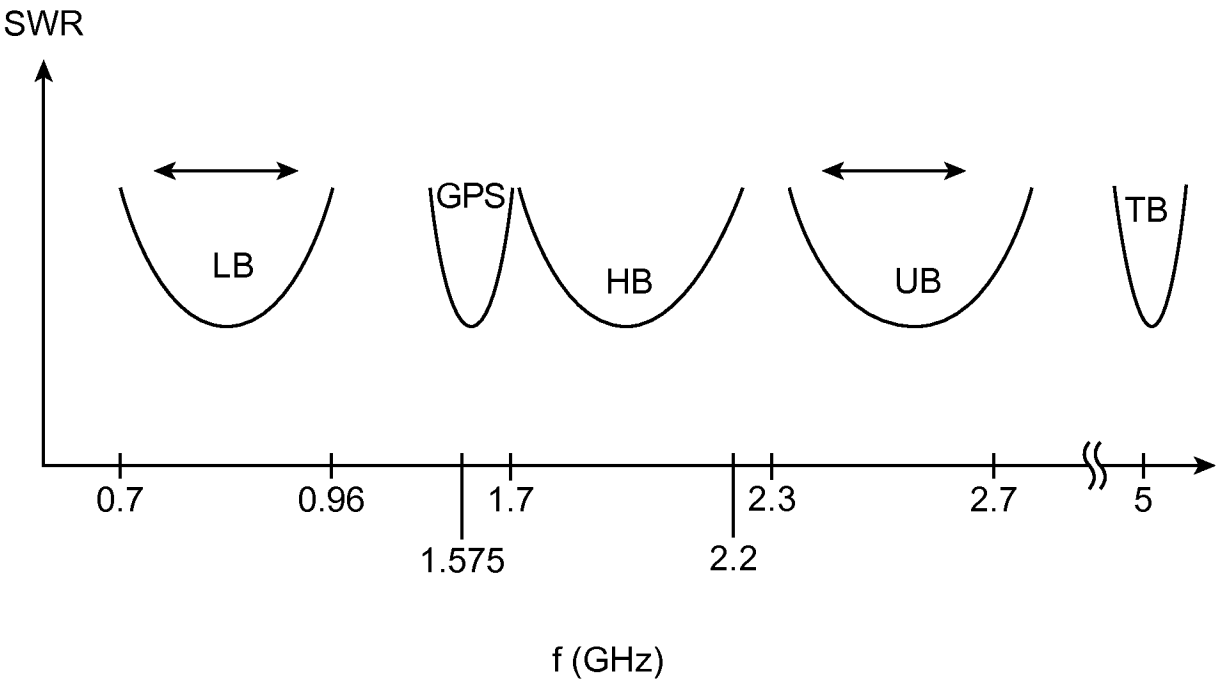
FIG. 6 is a graph of antenna performance as a function of frequency for a tunable antenna of the type shown in FIG. 5 in accordance with an embodiment of the present invention.

FIG. 6 is a graph in which antenna performance (standing wave ratio SWR) has been plotted as a function of operating frequency f for an electronic device with antenna structures such as antenna structures 40 of FIG. 5. As shown in FIG. 6, antenna structures 40 may exhibit a resonance at band LB using port 1A. Adjustable capacitor 106A may be adjusted to adjust the position of the LB resonance, thereby covering all frequencies of interest (e.g., all frequencies in a range of about 0.7 GHz to 0.96 GHz, as an example). Band HB (e.g., a cellular band from 1.7 to 2.2 GHz) may optionally be covered using port 1A. Antenna structures 40 may exhibit a resonance in band UB when using port 1A due to the presence of slot antenna resonating element 132, which serves as a parasitic antenna resonating element 132. The resonance associated with slot antenna resonating element 132 when using port 1A may be tuned across band UB using tunable capacitor 106B. When using port 1B, antenna structures 40 may exhibit a resonance at a satellite navigation system frequency such as a 1.575 GHz resonance for handling Global Positioning System signals. The antenna response in band TB (e.g., 5 GHz) may be associated with using port 2 as an antenna feed for slot antenna resonating element 132. At frequencies in communications band TB, slot 132 operates as a slot antenna for handling traffic for port TB of transceiver 116.

The foregoing is merely illustrative of the principles of this invention and various modifications can be made by those skilled in the art without departing from the scope and spirit of the invention.

What is claimed is:

1. Electronic device antenna structures, comprising:

an antenna ground;

an antenna resonating element that forms a first antenna with the antenna ground, wherein the first antenna has first and second ports; and a slot antenna resonating element having a third antenna port, wherein the slot antenna resonating element forms a second antenna that handles signals through the third antenna port and wherein the slot antenna resonating element forms a parasitic antenna resonating element for the first antenna.

2. The electronic device antenna structures defined in claim 1 wherein the slot antenna resonating element comprises a slot formed between portions of the antenna resonating element and the antenna ground.

3. The electronic device antenna structures defined in claim 2 wherein the antenna resonating element comprises a peripheral conductive electronic device housing structure.

4. The electronic device antenna structures defined in claim 3 wherein the first antenna comprises a dual arm inverted-F antenna.

5. The electronic device antenna structures defined in claim 4 wherein the slot antenna is configured to transmit and receive wireless local area network in a 5 GHz communications band using the third antenna port.

6. The electronic device antenna structures defined in claim 4 wherein the slot antenna resonating element is near field coupled to the antenna resonating element of the first antenna during operation of the first antenna at 2.4 GHz.

7. The electronic device antenna structures defined in claim 1 further comprising a band pass filter coupled to the second antenna port.

8. The electronic device antenna structures defined in claim 1 further comprising an adjustable capacitor coupled to the first antenna port.

9. The electronic device antenna structures defined in claim 1 further comprising an adjustable capacitor that bridges the slot.

10. The electronic device antenna structures defined in claim 9 wherein the adjustable capacitor is configured to produce an adjustable capacitor value that tunes an antenna resonance for the first antenna.

11. The electronic device antenna structures defined in claim 10 wherein the adjustable capacitor comprises switching circuitry and a plurality of fixed capacitors.

12. Apparatus, comprising:

radio-frequency transceiver circuitry configured to handle wireless local area network signals, satellite navigation system signals, and cellular telephone signals;

antenna structures having first, second, and third antenna ports, wherein the antenna structures include an inverted-F antenna resonating element to which the first and second antenna ports are coupled and a slot antenna resonating element to which the third antenna port is coupled;

a first adjustable capacitor coupled between the radio-frequency transceiver circuitry and the first antenna port; and a second adjustable capacitor that bridges the slot antenna resonating element.

13. The apparatus defined in claim 12 wherein the antenna structures are configured to handle radio-frequency signals in at least first and second communications bands using the first antenna port, wherein the first adjustable capacitor is configured to tune an antenna resonance in the first communications band and wherein the second adjustable capacitor is configured to tune an second antenna resonance in the second communications band.

14. The apparatus defined in claim 13 wherein the slot antenna resonating element forms a slot antenna for radio-frequency signals in a third communications band.

15. The apparatus defined in claim 14 wherein the third communications band comprises a wireless local area network communications band at 5 GHz and wherein the radio-frequency transceiver circuitry includes a wireless local area network transceiver that is configured to transmit and receive signals in the wireless local area network communications band at 5 GHz using the third antenna port and the slot antenna.

16. The apparatus defined in claim 15 wherein the radio-frequency transceiver circuitry comprises a satellite navigation system receiver coupled to the second antenna port.

17. The apparatus defined in claim 16 wherein the radio-frequency transceiver circuitry comprises a cellular telephone transceiver coupled to the first antenna port for transmitting and receiving signals in the first and second communications bands.

18. An electronic device, comprising:

antenna structures, wherein the antenna structures include an antenna ground, an inverted-F antenna resonating element that forms an inverted-F antenna with the antenna ground, and a slot antenna resonating element that serves as a slot antenna and as a parasitic antenna resonating element for the inverted-F antenna; and wireless circuitry that uses the inverted-F antenna to handle signals in a first communications band and that uses the slot antenna to handle signals in a second communications band.

19. The electronic device defined in claim 18 wherein the wireless circuitry comprises:

a wireless local area network transceiver; and transmission line structures coupled between the wireless local area network transceiver and the slot antenna resonating element, wherein the wireless local area network transceiver directly feeds the slot antenna resonating element so that the slot antenna handles wireless local area network signals in the second communications band.

20. The electronic device defined in claim 19 wherein the wireless circuitry comprises a cellular telephone transceiver and duplexer circuitry, wherein the duplexer circuitry has a first port that is coupled to the wireless local area network transceiver and a second port that is coupled to the cellular telephone transceiver.

21. The electronic device defined in claim 20 wherein the duplexer circuitry has a shared port coupled to the inverted-F antenna.

22. The electronic device defined in claim 21 wherein the inverted-F antenna has first and second antenna ports, wherein the shared port of the duplexer circuitry is coupled to the first antenna port.

23. The electronic device defined in claim 22 further comprising an adjustable circuit coupled between the shared port of the duplexer circuitry and the first antenna port, wherein the adjustable circuit is configured to tune the inverted-F antenna.

24. The electronic device defined in claim 23 wherein the adjustable circuit comprises an adjustable capacitor.

25. The electronic device defined in claim 18 further comprising an adjustable circuit that bridges the slot antenna resonating element.

26. The electronic device defined in claim 25 wherein the adjustable circuit comprises an adjustable capacitor.

27. The electronic device defined in claim 18 further comprising a housing having a peripheral conductive housing structure, wherein the inverted-F antenna resonating element comprises a portion of the peripheral conductive housing structure.

28. The electronic device defined in claim 27 wherein the slot antenna resonating element comprises a slot having edges formed from the portion of the peripheral conductive housing structure and the antenna ground, the antenna structures further comprising an adjustable capacitor that bridges the slot, wherein the adjustable capacitor is configured to tune the inverted-F antenna.

29. The electronic device defined in claim 28 wherein the inverted-F antenna comprises at least one antenna port and wherein the electronic device further comprises an additional adjustable capacitor coupled to the antenna port to tune the inverted-F antenna, wherein the adjustable capacitor is configured to tune the inverted-F antenna in the first communications band and wherein the additional adjustable capacitor is configured to tune the inverted-F antenna in a third communications band.

30. The electronic device defined in claim 29 wherein the first communications band comprises a communications band from 760 MHz to 960 MHz, wherein the second communications band comprises a wireless local area network communications band at 5 GHz, and wherein the third communications band comprises a communications band from 2.3 to 2.7 GHz, the electronic device further comprising control circuitry that is configured to control the adjustable capacitor and the additional adjustable capacitor.

* * * * *